US008348077B2

(12) United States Patent
Wimmer

(10) Patent No.: US 8,348,077 B2
(45) Date of Patent: Jan. 8, 2013

(54) BODIES, PACKAGES OF BODIES, AND A DEVICE AND METHOD FOR PACKAGING BODIES

(75) Inventor: Thomas Wimmer, Rosenheim (DE)

(73) Assignee: Krones AG, Neutraubling (DE)

( * ) Notice: Subject to any disclaimer, the term of this patent is extended or adjusted under 35 U.S.C. 154(b) by 177 days.

(21) Appl. No.: 12/800,872

(22) Filed: May 25, 2010

(65) Prior Publication Data

US 2010/0308043 A1 Dec. 9, 2010

(30) Foreign Application Priority Data

Jun. 3, 2009 (DE) ..... 10 2009 025 912

(51) Int. Cl.
*B65D 21/02* (2006.01)
*A47G 19/00* (2006.01)

(52) U.S. Cl. ..... 220/23.4

(58) Field of Classification Search ..... 220/23.2, 220/23.4; 206/504
See application file for complete search history.

(56) References Cited

U.S. PATENT DOCUMENTS

| | | | | |
|---|---|---|---|---|
| 3,069,575 | A | 5/1959 | Cook | |
| 4,416,373 | A | 11/1983 | deLarosiere | 206/432 |
| 4,982,858 | A | 1/1991 | von Holdt | |
| 5,002,199 | A | 3/1991 | Frahm | 220/670 |
| 5,310,071 | A | 5/1994 | Rivlin et al. | |
| 5,402,903 | A | 4/1995 | Mann | |
| 5,638,974 | A * | 6/1997 | Mann | 220/23.4 |
| 5,647,190 | A | 7/1997 | Minarelli | 53/446 |
| 6,276,549 | B1 | 8/2001 | Fasci et al. | 220/23.4 |
| D520,376 | S | 5/2006 | Noelle | D9/600 |
| 2003/0160018 | A1 * | 8/2003 | Yourist | 215/10 |
| 2004/0000550 | A1 | 1/2004 | Taccolini et al. | 220/23.4 |
| 2007/0114200 | A1 | 5/2007 | Lane | 215/10 |
| 2008/0202966 | A1 | 8/2008 | Fields et al. | |

FOREIGN PATENT DOCUMENTS

| | | |
|---|---|---|
| DE | 24 19 990 A1 | 11/1975 |
| DE | 43 05 340 A1 | 8/1994 |
| DE | 44 41 680 B4 | 6/1995 |

(Continued)

OTHER PUBLICATIONS

EPO machine translation of specification and claims of DE 24 19 990 A1 (6 pages).

*Primary Examiner* — Harry Grosso
(74) *Attorney, Agent, or Firm* — Davidson, Davidson & Kappel, LLC

(57) ABSTRACT

The invention relates to bodies that have a structuring with connecting elements formed around the entire girth of the body. Furthermore, the invention relates to packages including an arrangement of at least two bodies according to the invention, with the connecting elements of a first body cooperating with the corresponding connecting elements of a second body in a form-locking manner. Furthermore, the invention relates to a device for producing packages from bodies. The device has an alignment unit and at least one sliding device for form-lockingly connecting the aligned bodies, with at least two bodies at a time being rotated about their longitudinal axes in order to align corresponding connecting elements of the two bodies so that they can cooperate. The invention moreover relates to a method for producing packages from bodies, whereby at least two bodies are aligned first and subsequently assembled to form a first package, with the oppositely arranged connecting elements form-lockingly interlocking.

10 Claims, 12 Drawing Sheets

FOREIGN PATENT DOCUMENTS

| | | | |
|---|---|---|---|
| DE | 197 34 348 | A1 | 2/1999 |
| DE | 10 2004 047 830 | A1 | 3/2006 |
| DE | 20 2005 019 327 | U1 | 4/2007 |
| EP | 0 518 252 | A1 | 12/1992 |
| EP | 1 584 559 | A | 10/2005 |
| GB | 1910 18752 | A | 0/1911 |
| JP | 52-96169 | | 9/1993 |
| WO | WO 90/08 068 | A1 | 7/1990 |
| WO | WO 02/12077 | | 2/2002 |
| WO | WO 03/072446 | A1 | 9/2003 |
| WO | WO 2008/0 02 579 | A2 | 1/2008 |
| WO | WO 2009/150754 | A1 | 12/2009 |

* cited by examiner

BODIES, PACKAGES OF BODIES, AND A DEVICE AND METHOD FOR PACKAGING BODIES

This claims the benefit of German Patent Application 10 2009 025 912.0, filed Jun. 3, 2009 and hereby incorporated by reference herein.

The present invention relates to bodies that can be arranged together with other bodies of the same type to form sturdy packages. It further relates to a device and method for assembling packages from the bodies

BACKGROUND

For purposes of transportation, storage, and/or sale, filled bodies, such as bottles, cans, or similar packed goods are often packaged together in a bundle of several such bodies. Several bodies, for instance, are packed together in completely sealed cartons in one manufacturing process.

A further possibility is the use of so-called trays or pads on which the bodies, especially bottles, are placed. In order to fasten them together, foil is additionally wrapped around the majority of bottles and they are subsequently heat-shrunk. The foil can, however, also be used without applying trays or pads, namely in a so-called "shrink-only" process.

A major disadvantage of the processes described consists in the necessary use of additional packaging materials, i.e. in utilizing additional costly packaging material in combination with the appropriate packing machines. An especially adverse effect is the high energy consumption for shrinking the outer packaging in the shrink tunnel.

Functional bodies with connecting elements are known from DE 102004047830 A1. Said document shows a bottle with latches or snap-fits for connecting a number of such bottles to form constructive units. In this way, these units can be conveniently transported and stored and can be put to versatile uses when empty. In an empty condition the bodies are thereby easy to collect and to stack, whereas the latched connections require considerable effort for disconnecting.

DE 202005019327 U1 describes a body from plastic with a minimum of one notch, variable in depth and length, across at least a portion of the body. In the present case, the notch serves to withstand the pressure of carbonated drinks, in order to avoid a highly visible deformation of the bottle.

GB 18752 A shows a bottle with ribs arranged in a longitudinal direction, intended to prevent the bottles from rolling about, especially when they are arranged to lie on top of each other.

JP 52-96169 A shows a bottle with an octagonal outer cross-section and a circular inner cross-section, whereby the octagonal outer cross-section enables optimal close packing of a number of bottles.

U.S. Pat. No. 5,002,199 A shows an improved light weight bottle which is stackable. The bottle is preferably of rectangular cross-section with parallel, oppositely disposed mating indentations or elevations, permitting secure and space-saving stacking of the bottles.

The U.S. Design Pat. No. D52,0376 S shows a bottle form comparable to a puzzle piece with circular indentations on two and appropriate circular projections on the other two sides. The bottles can therefore be connected in the fashion of puzzle, forming a horizontal plane when lying.

WO 1990008068 A1 shows a bottle with a minimum of two indentations or recesses along the outer bottle surface, resulting in at least two handles, which are intended to allow a baby or infant to easily hold the bottle by itself.

WO 2008002579 A2 describes interlocking rectangular bodies made from plastic with the lateral area featuring at least two movable vacuum panels. The shoulder region and the base portion of the body define an interlocking structure suitable to achieve a nesting relationship with complementary mating surfaces of the adjacent bodies.

SUMMARY OF THE INVENTION

It is an object of the present invention to provide a body that can be easily assembled in packages with the bodies being detachable from each other so that preferably no or only little additional wrapping and especially no shrinking foil for outer packaging is necessary. A further alternate or additional task of the invention is to provide a package, wherein the bodies are detachably interlocked without or with only very little additional wrapping. Yet a further alternate or additional task is to provide a device for producing packages from bodies according to the invention as well as an appropriate method for producing said packages.

The present invention relates to bodies that can be assembled together to form sturdy and yet detachable packages, whereby preferably no additional packaging material is needed. The bodies according to the invention are preferably bottles and they consist especially of plastic, for example PET, and they are used in the beverage industry.

A body according to the invention has an essentially circular base shape and comprises a base, a lateral surface, and a closure that is preferably disposed on top, opposite to the base. The closure can be a reclosable screw top, a snap-fit cap, or a similar closure, but also a non-reclosable one-way closure.

According to the invention, the lateral surface and, where applicable, the base, too, and/or the closure are formed with a structuring. The structuring of the lateral surface is arranged essentially parallel to the longitudinal axis of the body, whereby the longitudinal axis is perpendicular to the base of the body. The structuring of the lateral surface comprises connecting elements around the entire girth of the body, extending along more than four sides of the lateral surface.

According to a preferred embodiment, the connecting elements are formed like ribs. Accordingly, a notch results between every two ribs, with the notches and ribs being formed such that they engage in a form-locking manner with one another.

The ribs can be shaped in such a way that they are formed with or without undercut. In a particularly preferred mode of embodiment there is an undercut between ribs and notch. The undercut enables a form-locking, constantly stable connection between a rib of a first body and the corresponding notch of a second body.

According to a further embodiment, there is no undercut formed between ribs and notch. In general, this will only result in a form-locking connection between the rib of a first body and the corresponding notch of a second body.

According to a further embodiment, an undercut is formed as the result of pressing the rib of a first body into the corresponding notch of a second body. The body, i.e., features no undercut in a produced state; the undercut is not formed until two bodies are arranged and connected, thus creating a force-fit connection.

The connecting elements according to the invention can extend along the entire lateral surface of the bodies, or alternatively only along a portion thereof. According to one embodiment, the connecting elements extend only along one axial section of the lateral surface. According to a preferred embodiment, the connecting elements extend along an upper and along a lower axial section of the lateral surface, while the perimeter of the body in between these sections is reduced, resulting in a sort of grip area.

Furthermore, the connecting elements may comprise additional securing elements that serve to produce a force-fit connection between at least two bodies. In particular, it is possible to form the securing elements as elevations and indentations, with the elevations preferably arranged in the notches and the indentations preferably on the ribs. According to a further embodiment, the elevations are preferably arranged on the ribs and the indentations preferably in the notches. Furthermore, it is possible to arrange at least one indentation as well as at least one elevation on the ribs, while accordingly arranging the corresponding securing elements in the notches.

The body according to the invention may, according to a further embodiment, comprise a shoulder at the base and/or at the top. The shoulder serves as a sort of stop for two such connected bodies, preventing the bodies from shifting axially.

The production of the bodies according to the invention with or without undercut is preferably carried out by means of the customary blow molding or stretch blow molding processes. For producing bodies without undercut in the area of the notches, it is possible to apply the customarily known process with a blow mold consisting of two parts that are opened along an axis extending perpendicular to the base of the body.

A different blow mold would, however, have to be applied for producing bodies with an undercut in the area of the notches. Said blow mold comprises, for example, at least two parts that are opened across an axis extending perpendicular to the base of the body.

A further possibility is the use of bodies that, in a produced state, initially feature no undercut in the area of the notches. The undercut rather forms as a result of pressing the bodies together. In particular, the undercut only develops with the form-locking connection of two such bodies with each other, resulting in a force-fit connection at the same time.

A positive side-effect of the present invention is that the bodies feature an extraordinary stability due to their form, making it possible to produce especially thin-walled bottles.

The present invention furthermore relates to packages comprising an assembly of at least two bodies, with the bodies comprising a base, a top side, and a lateral surface, whereby the lateral surface preferably has a structuring with connecting elements formed around the entire girth of the body and with the connecting elements being arranged essentially parallel to the longitudinal axis of the body, extending along more than four sides of the lateral surface, whereby the longitudinal axis is perpendicular to the base of the body.

The connecting elements are preferably formed as ribs with intermediate notches with or without undercut and they extend at least along an axial section of the lateral surface.

The connecting elements of the bodies assembled as packages may comprise further securing elements, especially in the form of elevations and indentations.

Furthermore, the bodies to be assembled as packages may comprise so-called shoulders or projections at the base and/or in the upper area. The said shoulders prevent an axial shifting of the connected bodies.

According to a further embodiment, there are adhesion points arranged between the bodies, with the adhesive also preventing the bodies from shifting axially.

A further embodiment provides for additional securing of at least two packaged bodies by means of a banderole. The assembly of bodies with connecting elements extending only along an upper and a lower area results in a grip area that is more or less located in the center of the bodies. When packaging said bodies together, the banderole is preferably affixed in this unstructured area.

According to a further embodiment, the package features a handle. The handle comprises at least one fastening area and at least one holding area. The fastening area is preferably designed in such a way that it interlocks form-lockingly and force-fittingly between the connecting elements, in particular into a notch between two ribs.

According to one embodiment, the handle comprises a molded part, in particular an injection-molded part or the like, and it comprises two fastening areas as well as one holding area of a width approximately twice the perimeter of the bodies to be assembled together. The fastening areas are preferably shaped cylindrically. It is also possible, however, that the handle serves for surrounding three or more containers that are arranged in a row. The width of the holding area must then be accordingly adjusted.

According to a further embodiment, a handle comprises two broadly cylindrical fastening areas with a holding area—in the form of a foil strip, a cord, or the like—arranged in between.

The handle is easily fastened: The fastening area between two connecting elements of a first body is fastened to, in particular clipped into, the other fastening area between two connecting elements of a second body. Thereby, the first and the second body are form-lockingly and preferably also force-fittingly connected with each other. The fastened handle forms a sturdy transporting unit with the bodies. Handle and bodies are thereby detachable from each other.

The special advantage of a package comprising the bodies according to the invention, with or without the handle described above, is that no outer packaging in the form of foil or a carton etc. is necessary, and that as a result, no additional costs for material are incurred. This dispenses with time-, energy-, and cost-consuming processes such as folding boxes or shrinking foils. Certain devices, such as the shrink tunnel, are also dispensed with. Banderoles or the like may certainly be applied for additional securing against axial shifting. The resulting costs for packaging are, however, lower than for the use of shrinking foil for outer packaging, for example.

The invention further relates to a device for assembling bodies to form sturdy, self-supporting packages with the individual bodies being easily detachable from each other.

The device for producing packages from bodies with structuring and connecting elements comprises an alignment unit and at least one sliding device.

The alignment unit rotates at least two bodies about their longitudinal axes, thus aligning the corresponding connecting elements of the two bodies so that they can cooperate with each other. The connecting elements of the two bodies are each aligned essentially parallel to their longitudinal axes.

The at least one sliding device is used for pushing together at least two bodies so that the rib of the first body is inserted into the notch formed between two ribs of the second body, thus resulting in a form-locking and preferably also force-fit connection between the two bodies. In this manner, a first package comprises at least two bodies is formed.

According to a further embodiment, the alignment unit aligns three or more bodies at a time. At least one sliding device subsequently connects these bodies to form linear packages of three or more bodies of the same kind.

According to a further embodiment, the device features a second sliding device that assembles the bodies connected by the first device to form a bigger unit. In particular, said device is a separating and arranging unit, in the form of an article divider, for instance. The required number of first-package-units produced by the first sliding device is arranged parallel to each other and pushed together. Said process in turn results in a form-locking and preferably also force-fit connection between the bodies of the first-package-units, thus forming larger packages that comprise several rows of bodies.

The alignment unit monitors the aligning of the bodies by means of image recognition systems, for example. These recognize e.g. the connecting elements of the bodies and generate appropriate signals, which are transferred to a control device, which in turn monitors the alignment unit and thus controls the appropriate rotation of the bodies.

The alignment unit aligns the bodies, for example, by twos at a time and the first sliding unit groups them into form-locking pairs of bodies. Three such body pairs arranged and connected with each other by the separating and arranging unit, and, for example, clipped together, will result in the common, rectangular shaped six-packs.

According to a further embodiment, the alignment unit arranges the bodies by threes at a time and the first sliding unit groups them into form-locking, linear units of threes. Three such linear units of threes, arranged and connected with each other by the separating and arranging unit, and, for example, clipped together, will result in square-shaped packages of nine.

The expert can readily imagine further variations for producing larger packages in this way; the corresponding description is therefore dispensed with.

Furthermore, it is possible to align, for example, three bodies, which are then assembled to form a triangular unit by the first sliding unit. Two such triangular units assembled by the second sliding unit will result in rhomboid-shaped six-packs.

The second sliding unit arranges the first-package-units in the requested manner by means of so-called divider bars that rest in a guiding slot. The divider bars are preferably operated independently of each other by separate drives.

It is furthermore possible that said device for producing packages is equipped to apply adhesion points. The said equipment can, for instance, be allocated to the first and/or to the second sliding unit. Applying adhesion points serves for additional, secure body connection—and especially prevents axial shifting—within a package assembled by a device as described above.

Furthermore, the invention relates to a method for assembling bodies with a structuring and with connecting elements to form sturdy packages. The method for producing packages comprises, as a first step, the alignment of at least two bodies, with the bodies being rotated about their longitudinal axes. The alignment unit thereby rotates the bodies preferably in such a way that the corresponding connecting elements of at least two bodies are aligned so that cooperating connecting elements are arranged opposite each other. The connecting elements of the bodies are arranged essentially parallel to the longitudinal axes of the bodies and preferably comprise ribs and notches arranged in between. The notches are formed in such a manner that one rib of a first body can interlock form-lockingly and preferably force-fittingly with a notch of a second body.

In a second step, the said at least two bodies with oppositely arranged connecting elements are form-lockingly connected with each other. These two process steps result in a first package comprises at least two bodies.

According to a further embodiment, the method comprises a third step for arranging and assembling at least two first packages to a second package. There is a multitude of possibilities for this step, which were in part discussed above in the context of the device for producing packages. The repeated description is therefore dispensed with.

According to a further embodiment, adhesion points are additionally applied to the bodies, namely at their contact areas, either before or during the second process step and/or before or during the third process step. The additional gluing mainly serves to prevent the bodies from shifting axially.

According to a further embodiment, the bodies can also be assembled synchronized by a robot. In particular, the connecting elements of at least two bodies can be assembled in an axial direction.

The connecting elements, in turn, are preferably formed as ribs and as corresponding notches, respectively. The method according to the said embodiment involves inserting at least one rib of the first body into at least one notch of the second body. The said method is particularly suitable for bodies with connecting elements that have a pronounced undercut, as this form does not require the ribs to be clipped into the corresponding notches, while nevertheless producing a form-locking and force-fit connection between the two bodies.

This method, again, allows for securing the connected bodies against axial shifting by applying hot glue along the ribs to be connected or else by dripping or spraying the glue from the top onto the joining point.

BRIEF DESCRIPTION OF THE DRAWINGS

The exemplary embodiments in the following passages, with the aid of the attached figures, are intended to explain in detail the invention and its advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

Figure 1B:
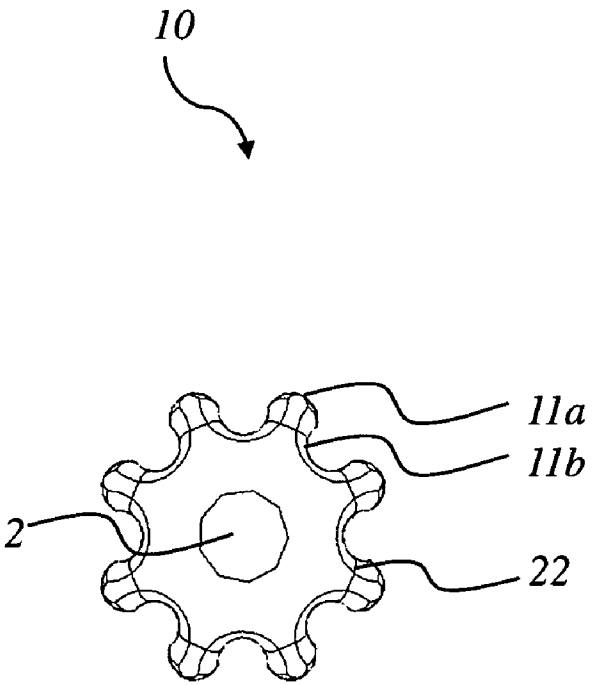
FIGS. 1*a* and b show a first embodiment according to the invention.

The same or equivalent elements of the invention are designated by identical reference characters. For the sake of clarity, only the reference characters relevant for describing the respective figure are provided. It should be understood that the embodiments described are only examples of designing the bodies, the packages, the device, or the method according to the invention, and they are not intended to limit the scope of the disclosure.

Figure 1A:
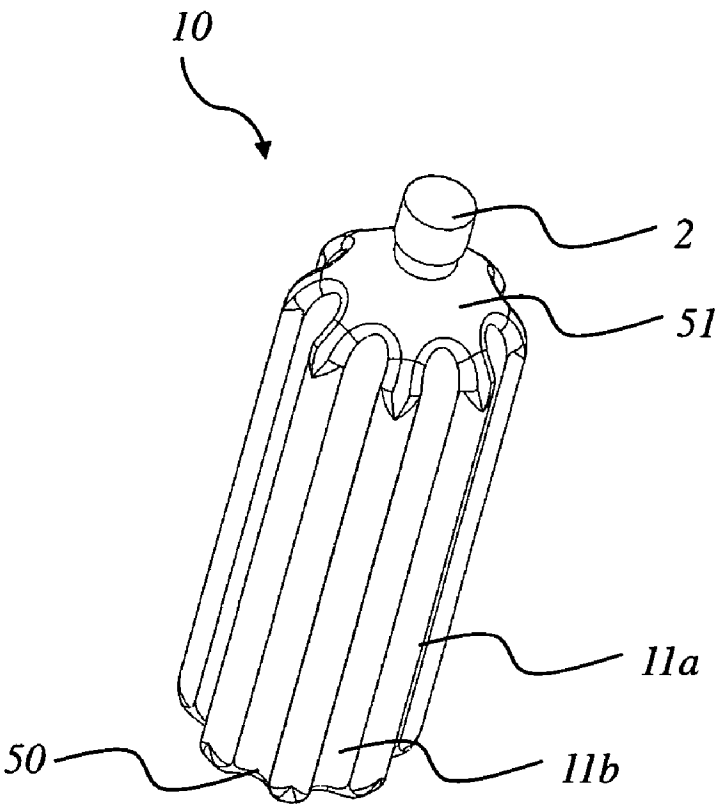

FIGS. 1*a* and 1*b* illustrate a first embodiment according to the invention. This is a specially shaped bottle 10 with a base area 50 and an upper area 51, with a closure 2 located in the upper area 51, and with the. bottle 10 featuring a structuring along the longitudinal axis that is perpendicular to the base 50, and with the structuring designed as connecting elements in the form of ribs 11*a* and notches 11*b* arranged between every two ribs and extending along the entire length of the bottle 10 (cf. especially FIG. 1*a*).

Figure 5B:
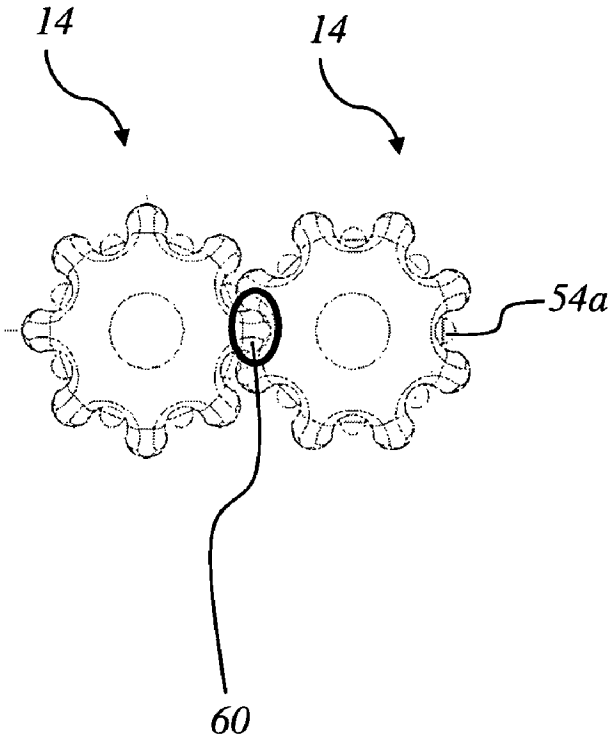
FIGS. 5*a* and b show two bodies interlocking according to the third embodiment illustrated in FIG. 3.
Figure 5A:
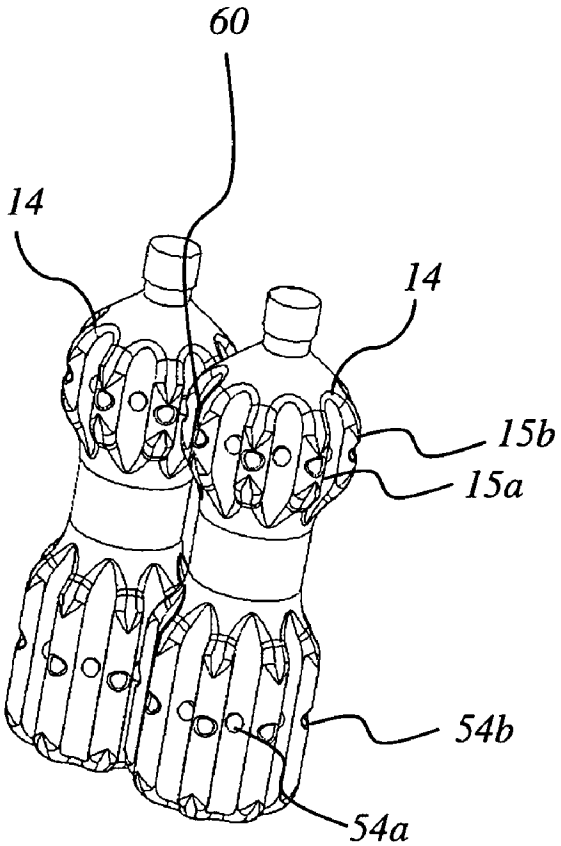
Figure 6A:
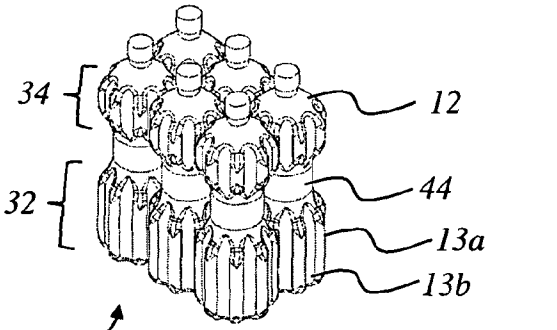
FIGS. 6*a* to d show various views of a package comprising six bodies according to the second exemplary embodiment illustrated in FIG. 2.
Figure 6C:
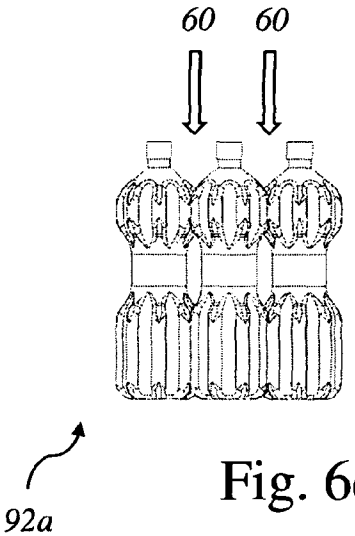
Figure 6B:
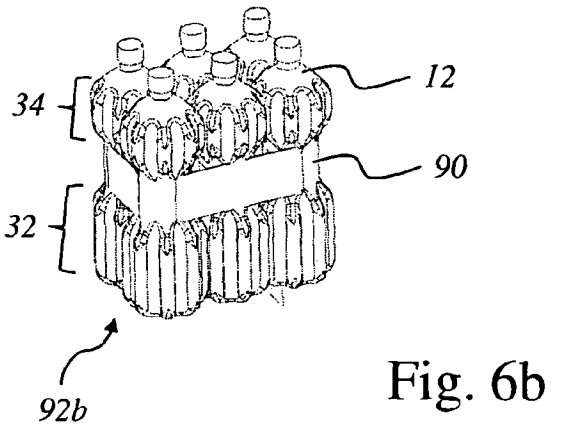
Figure 6D:
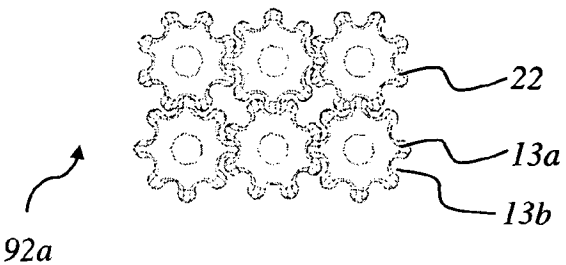

The ribs 11*a* of a first body 10 are formed such that they can interlock form-lockingly with the notches 11*b* of a second body 10 (cf. also FIGS. 5*a* and 6*d*).

FIG. 1*b* illustrates a top view of bottle 10 and thus illustrates the cross-section of such a bottle 10. As is easily recognizable in FIG. 1*b*, the described structuring with connecting elements, in particular with the ribs 11*a* and notches 11*b*, results in a cross-section resembling a toothed wheel or cogwheel, preferably with an undercut 22 in the area of the notches 11*b*. This undercut 22 is advantageous for radially clipping together several bottles 10 in a form-locking manner and thus creating a force-fit connection between at least two bottles 10 (cf. also FIGS. 5*a*, 5*b*, 6*a*, 6*b*, and 6*d*).

The closure is preferably a screw top, but it is also possible to use other closures, for example snap-fit caps or the like.

Figure 2:
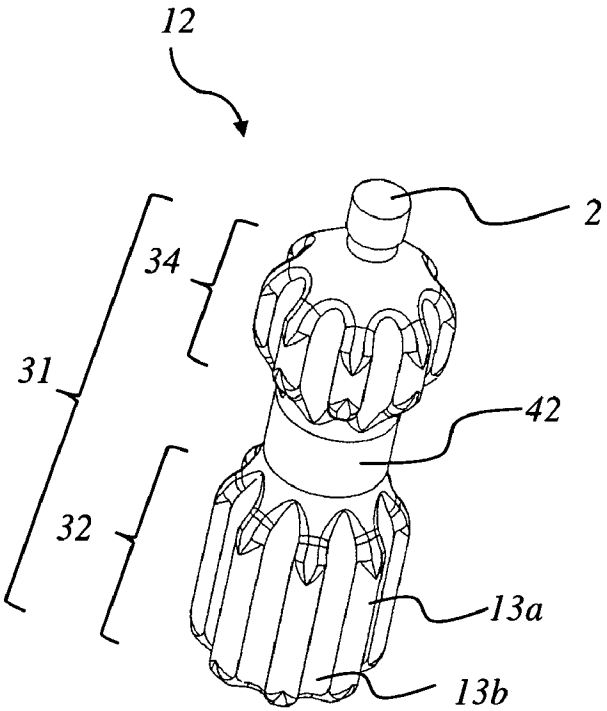
FIG. 2 shows a second embodiment according to the invention.

FIG. 2 illustrates a second embodiment 12 according to the invention. Here the cogwheel-like cross-section extends along a lower and an upper area 32, 34 of the bottle's height 31. Between the lower area 32 and the upper area 34 of the bottle's height 31, the cross-section of bottle 12 is preferably circular, oval, or ellipsoidal. This part of the cross-section is smaller than the cogwheel-like cross-section of the upper area 32 or the upper area 34, respectively, resulting in a grip area or a grip recess 42, respectively, allowing the user to ergonomically grip and hold bottle 12. The unstructured area 42 must in particular have a smaller cross-section than the structured areas 32, 34, so that it is possible for the connecting elements in the form of ribs 13*a* and notches 13*b* of the structured areas 32 and 34 of two bodies 12 to interlock.

Figure 3:
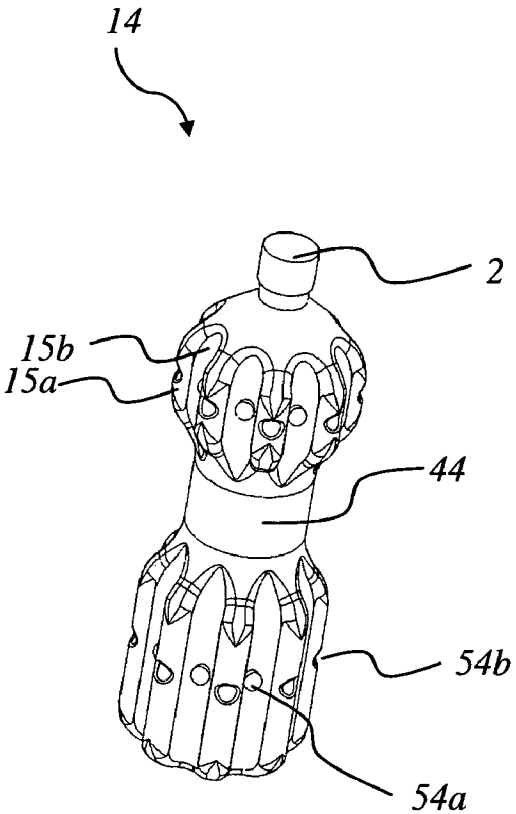
FIG. 3 shows a third embodiment according to the invention.

FIG. 3 illustrates a third embodiment 14 according to the invention with a grip recess 44. The said embodiment resembles the second embodiment of a body 12 from FIG. 2 but excluding the fact that it comprises additional securing elements in the form of elevations 54*a* in the notches 15*b* and indentations 54*b*, respectively, on the ribs 15*a*. The elevations 54*a* and the indentations 54*b*, respectively, are formed in such a way that the elevations 54*a* of a first bottle 14 interlock form-lockingly with the indentations 54*b* of a second bottle 14, in particular clipped into them, and they form a sturdy, detachable connection. The elevations 54*a* and the indentations 54*b*, respectively, thus serve as additional securing means for producing a sturdy, detachable connection between two or more bottles 14 according to the third embodiment.

It is clear to the expert that the arrangement of elevations 54*a* and indentations 54*b*, respectively, is not limited to the illustrated exemplary embodiment 14. It is also possible to arrange the elevations 54*a* on the outside radii of the ribs 15*a* and the indentations on the inside radii of the notches 15*b*. Another obvious possibility is to provide a bottle 10 according to the first embodiment with such elevations 54*a* on the ribs 11*a* and indentations 54*b* in the notches 11*b*, respectively.

Figure 4:
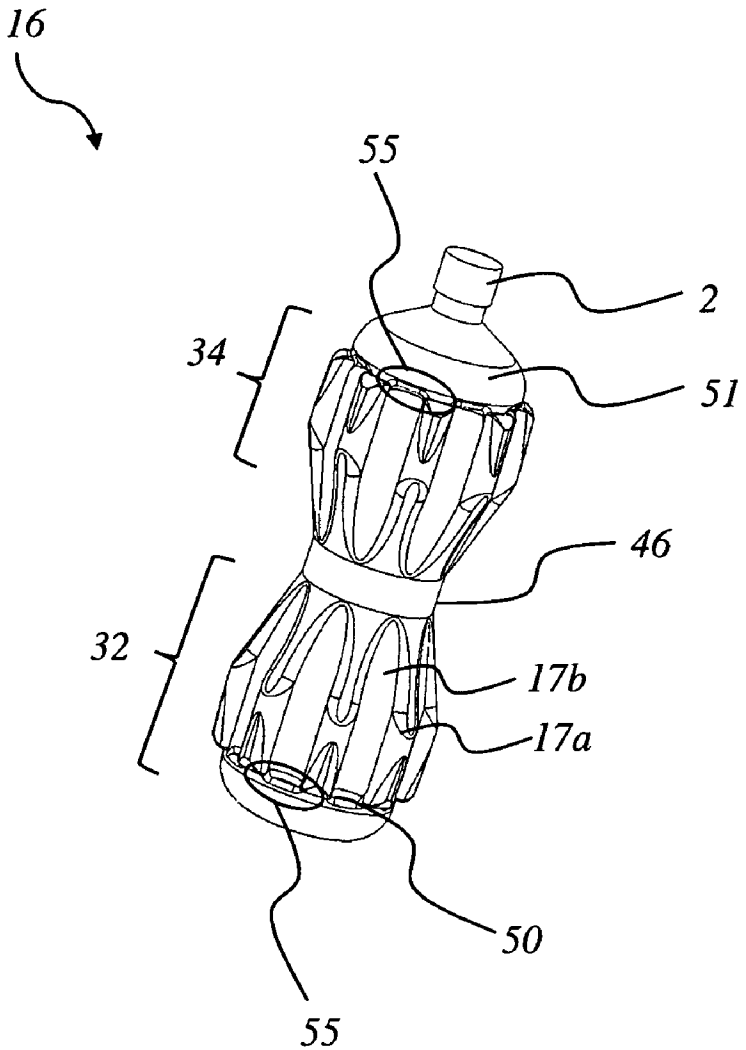
FIG. 4 shows a fourth embodiment according to the invention.

FIG. 4 illustrates a fourth embodiment 16 according to the invention with a grip recess 46, which in turn represents a variation of the second embodiment 12 (cf. FIG. 2). In this case, the ribs 17*a* each taper in the lower area 32 and in the upper area 34 towards the grip recess 46. This makes it possible to design the area of the grip recess narrower, with bottle 16 still having an ergonomically convenient hold.

According to the embodiment depicted here, bottle 16 comprises a shoulder or stop 55 in the area of the base 50 of the bottle 16 and in the upper area 51 of bottle 16 opposite to the notches 17*b*. This shoulder 55 is in particular intended for axial securing of two form-lockingly and force-fittingly connected bottles 16.

Another obvious possibility is to provide the said embodiment 16 with elevations and indentations, respectively, according to embodiment 14 shown in FIG. 3, in order to additionally secure the bodies, in particular against axial shifting.

FIGS. 5*a* and 5*b* illustrate two bodies interlocking according to the third embodiment 14, as shown in FIG. 3. The additional elevations 54*a* are clearly recognizable in said figure. The elevations 54*a* and the corresponding indentation 54*b* together form a connection 60 between the two bottles 14 in the area of the interlocking ribs 15*a*, with the connection 60 being form-locking and detachable.

FIGS. 6*a* to 6*d* each illustrate a package 92*a/b* comprising six bodies according to the exemplary embodiment 12, as shown in FIG. 2. The bottles 12 in the package 92*a* according to FIG. 6*a* are clipped to each other in a detachable connection holding them together. In package 92*b* according to FIG. 6*b*, the bottles 12 are additionally secured against axial shifting by means of an additional banderole 90. The banderole 90 can, for instance, be a carton or paper strip. Furthermore, banderole 90 can be a strip made of plastic foil, in particular a self-adhesive, label-like plastic strip, an elastic (rubber) band, or the like.

In a package 92*a* according to FIG. 6*a* and FIG. 6*c* it is possible to provide axial securing by applying, for example, an adhesive, in particular a hot glue 60, along the rib 13*a* to be joined. It is also possible to apply the glue by dripping or spraying it from the top onto the joining point. Furthermore, it is possible to employ adhesion points that will form a detachable connection under the pressure that results from clipping rib 13*a* into the corresponding indentation or notch 13*b*.

According to the embodiments represented here, the bodies 10, 12, 14, and 16 according to FIGS. 1 to 4 are preferably provided with an undercut 22, allowing them to be easily clipped together to form packages 92*a*, as exemplarily illustrated in FIG. 6*d*. Even though the bottles 12 in fact have a cogwheel-like cross-section, the indentations between the ribs 13*a* however have no undercut. In this case, the bodies definitely have to be connected with each other by means of glue, a banderole, or the like, as only a form-locking, and no force-fit connection is possible here.

Furthermore, the bottles' shoulders can be designed (cf. embodiment 16 in FIG. 4) to prevent axial shifting of the bottles.

Figure 7B:
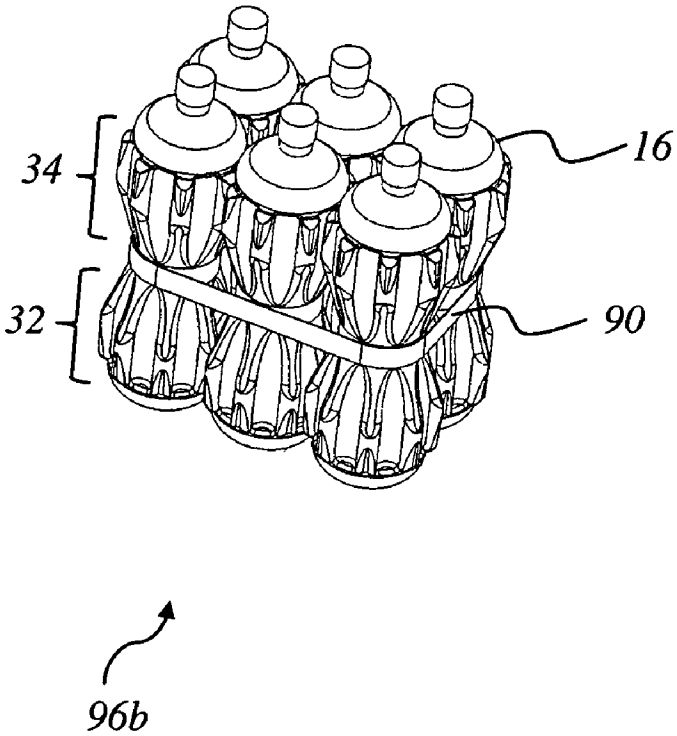
FIGS. 7*a* and b each show a package comprising six bodies according to the fourth exemplary embodiment illustrated in FIG. 4.
Figure 7A:
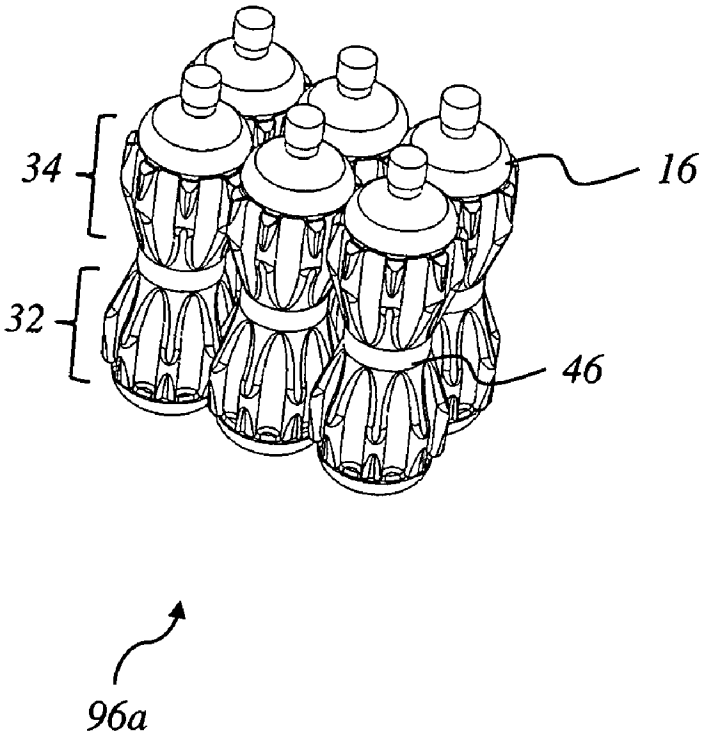

FIGS. 7*a* and 7*b* each illustrate a package 96*a/b* comprising six bodies according to the fourth exemplary embodiment 16, as shown in FIG. 4. The connection between the bodies 16 corresponds to the exemplary embodiment shown in FIGS. 6*a* to 6*d*; the repeated description is therefore dispensed with.

It is thus clear to the expert that it is also possible to produce appropriate packages according to the first and the third embodiments from the bodies 10 and 14 according to the invention. Furthermore, the number of bottles assembled in a package is not limited to six. In fact, packages comprising preferably of two, four, eight, or ten bodies according to the invention are also possible. Furthermore, this is to be understood to not only include packages with a rectangular base shape, but rather such packages with the bodies arranged in the shape of a rhomboid, too. Furthermore, the invention is intended to also include packages with an uneven number of bodies, in particular three, five, seven, or nine bodies, which are arranged in packages with, for example, a triangular base shape, a hexagonal base shape, or the like.

Accordingly, it is clear to the expert that the number of the ribs 11*a*, 13*a*, 15*a*, 17*a* of the bodies 10, 12, 14, and 16 according to the invention (cf. FIGS. 1 to 4) is not determined to be eight ribs 11*a*, 13*a*, 15*a*, 17*a*, as this is shown in the depicted exemplary embodiments 10, 12, 14, and 16. The number of the ribs 11*a*, 13*a*, 15*a*, 17*a* can be varied according to the required arrangement of the packages, with the number of the ribs 11*a*, 13*a*, 15*a*, 17*a*—and accordingly the number of the notches 11*b*, 13*b*, 15*b*, 17*b* in between—being preferably between five and twelve.

Figure 8B:
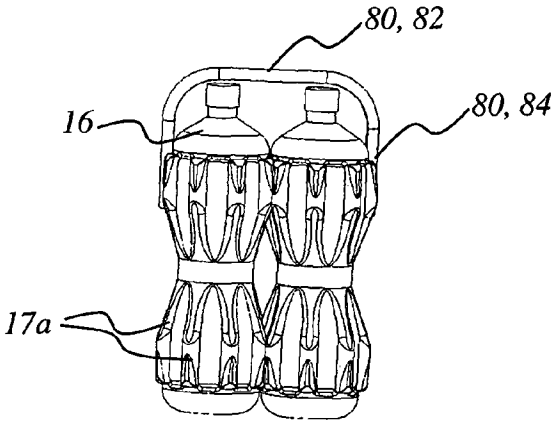
FIGS. 8*a* to 8*c* show a handle for use with the bodies according to the invention.
Figure 8C:
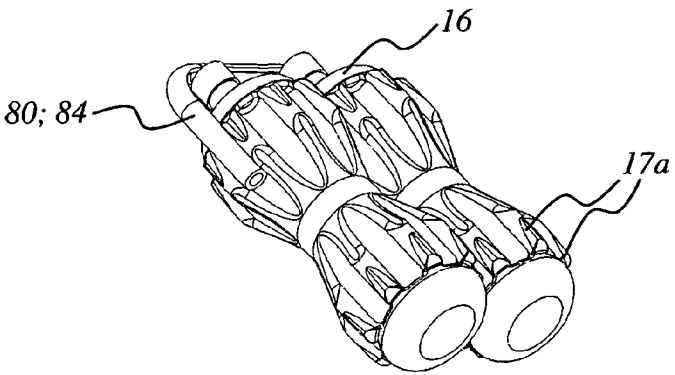
Figure 8A:
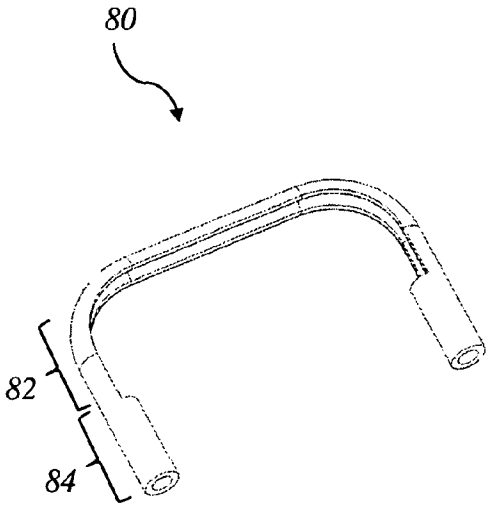

FIG. 8*a* illustrates a handle 80 for use with the bodies according to the invention. Handle 80 is a molded part made of plastic with a holding area 82 and at least one fastening area 84. The fastening area 84 is formed in such a manner that it can be clipped in between the ribs 11 of the bodies 10, 12, 14, and 16 according to the invention (cf. FIGS. 1 to 4), thus resulting in a sturdy, detachable connection.

FIGS. 8*b* and 8*c* illustrate the use of the handle 80 according to FIG. 8*a* together with bodies 16 according to the fourth exemplary embodiment, as shown in FIG. 4. Thereby the fastening areas 84 of the handle 80 are detachably clipped between the ribs 17*a*, i.e. into the notches 17*b* of the bottles 16. In this way, the buyer or user can easily remove the handle 80 and separate the bottles 16 from one another.

According to a further embodiment (not shown), the handle comprises two cylinders or the like, which are connected to each other by a carton or foil strip, a rope, or the like, whereby the cylinders interlock with the indentations of the bottles 10, 12, 14, 16, creating form-locking connections, according to the principle described above.

Figure 9:
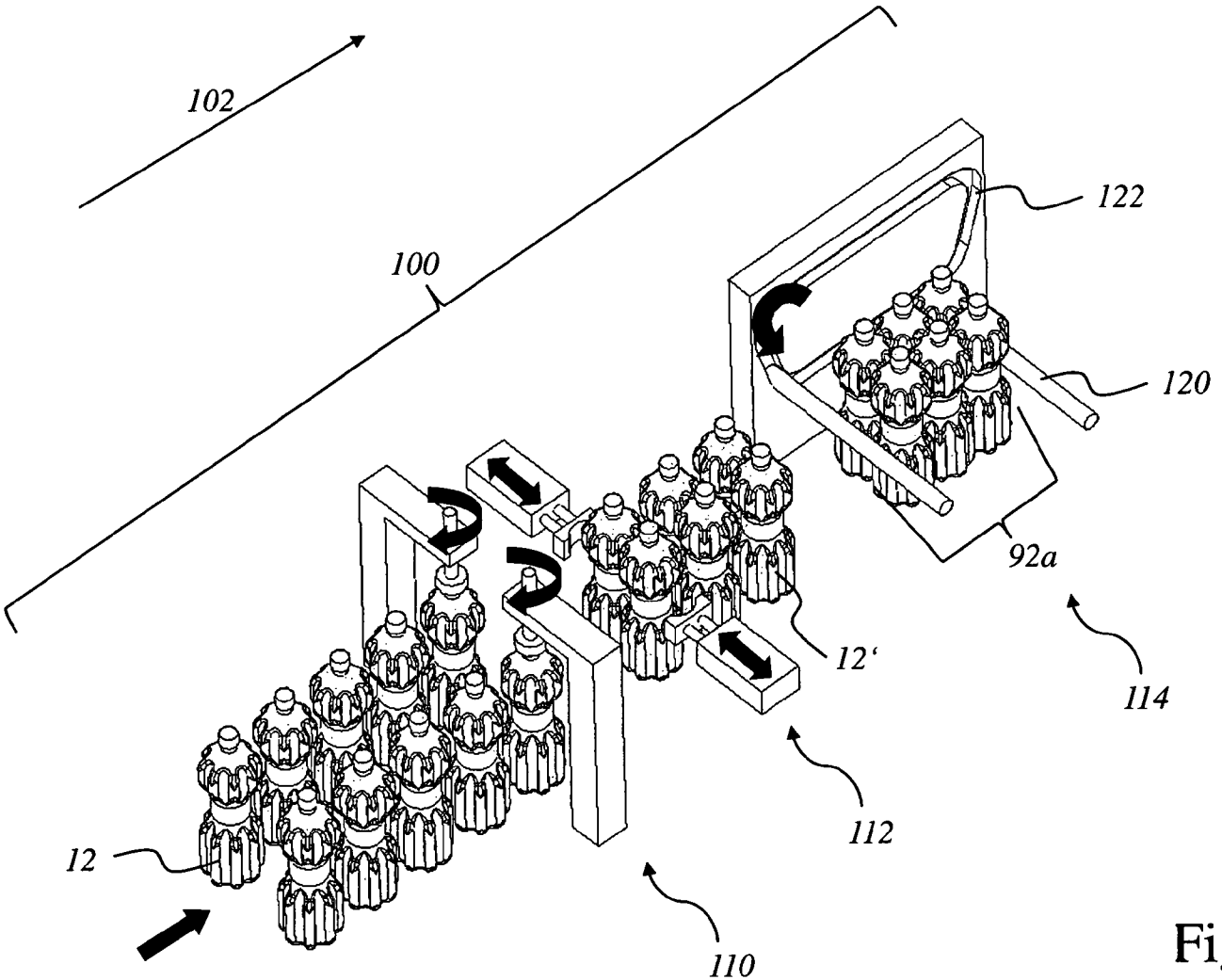
FIGS. 9 to 11 show various views of a device for assembling bodies according to the invention as packages.
Figure 10:
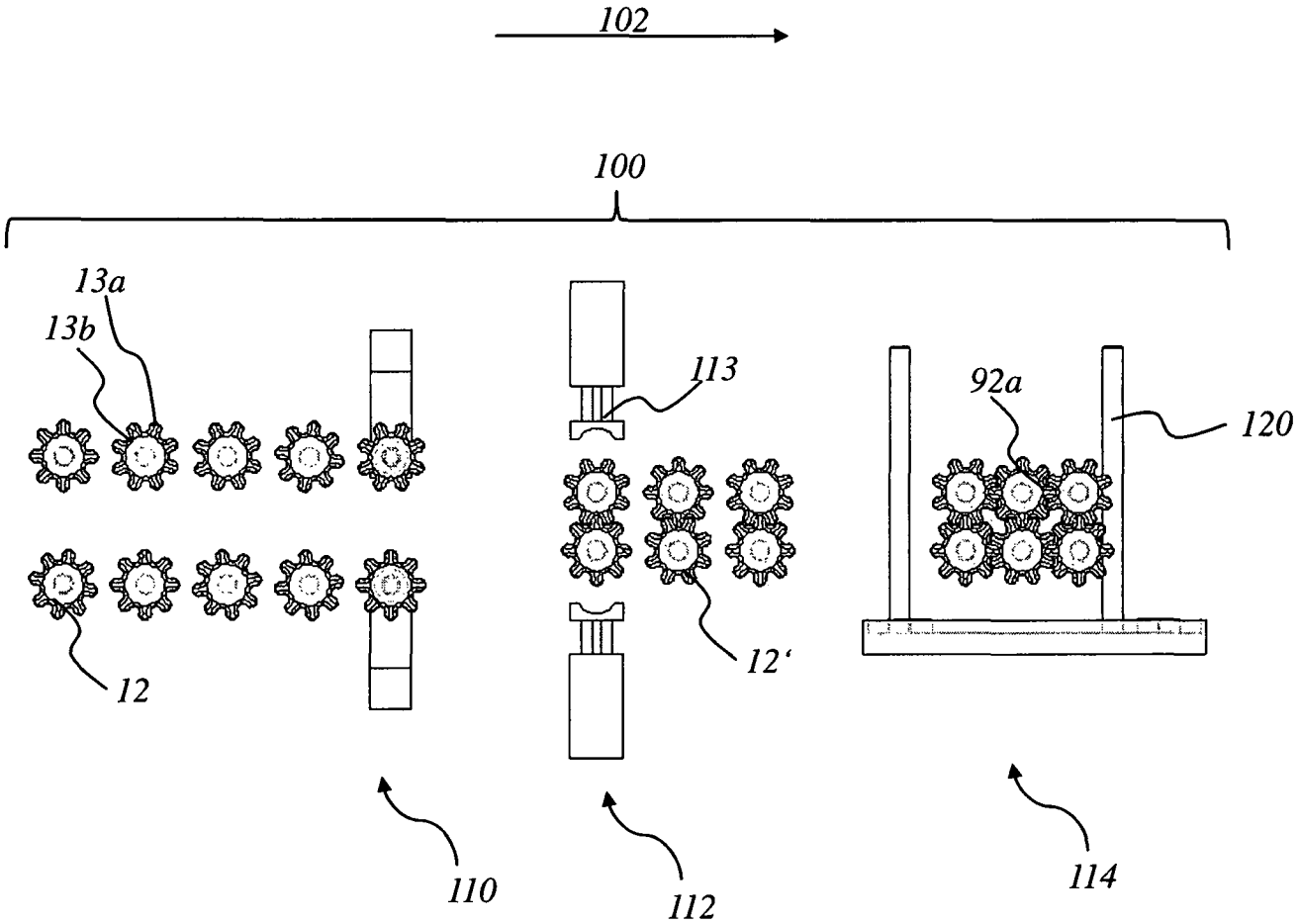
Figure 11:
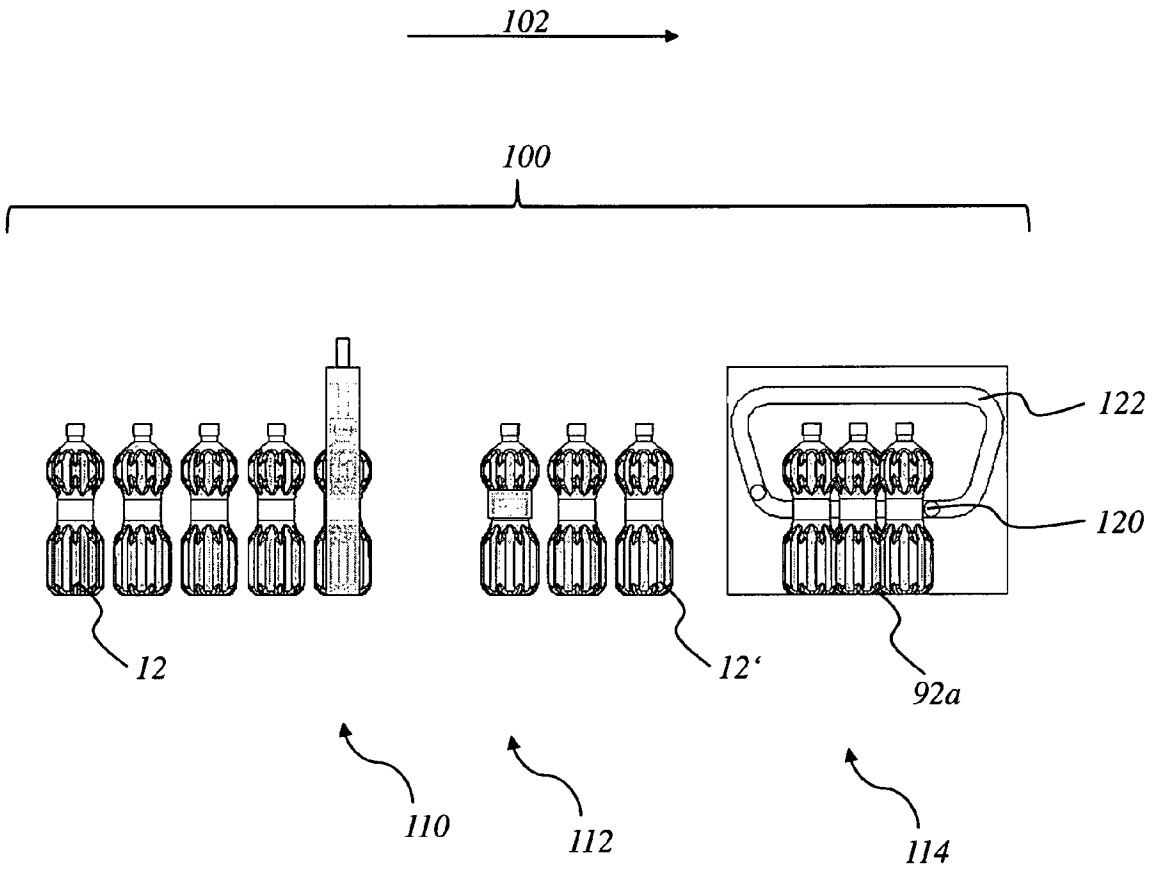

FIGS. 9 to 11 illustrate various views of a device 100 for producing packages from bodies according to the invention. The presented device 100 comprises an alignment unit 110, a first sliding device 112, and a second sliding device 114.

The bottles 12 according to the second embodiment from FIG. 2 are supplied in transportation direction 102 in a continuous flow. This is performed, for example, by means of an endless conveyor, supplying the bottles in a parallel flow. In a synchronized operating flow, an alignment unit 110 in the form of an alignment head first rotates the bottles 12 to the correct position for clipping in. In particular, the bottles are aligned in such a way that rib 13*a* of a first bottle 12 points in the direction of a notch 13*b* of a second bottle 12. On pressing together the bottles 12, the ribs 13*a* of the first bottle 12 can cooperate with the notch 13*b* of the second bottle 12.

The bottles 12 are subsequently transported, for example by means of a second endless conveyor, to a first sliding device 112, for example in the form of two slides. The slides 112 press together the aligned bottle pairs 12' transversely to the transportation direction, thus radially connecting them with each other to form a first, form-locking package. The bottle pairs 12' are subsequently transported to a second sliding device 114, a so-called separating and arranging unit, for example in the form of an article divider. They are transported there by means of, for example, the second or a third endless conveyor. The article divider 114 aligns the required number of bottle pairs 12' in the running direction and arranges and presses them together to form the packages 92*a*. In the present exemplary embodiment, the article divider 114 presses together bottle pairs 12' by threes, resulting in common six-packs 92*a*. It is also possible for the article divider 114 to sort out and press together, for instance, two, four, etc. pairs 12', accordingly resulting in packages of four, eight, etc. bottles.

The slide 112, which is used for pressing together the bottles 12 to make the bottle pairs 12', is preferably formed like a mold cavity plate 113, clamping the bottles for instance at their grip recess 42. This serves especially to prevent the bottles 12 from turning out of position again. It is in particular intended to prevent the ribs 13*a* and notches 13*b*, which have previously been aligned by the alignment unit 110, from turning out of position and thus disabling a form-lock and force-fit.

It is also possible to use only one active slide 112, with the first bottle group 12' being produced by pushing the two bottles 12 against a fixed wall.

The article divider 114 arranges the bottle pairs 12' according to the requested sort of package by means of so-called divider bars 120, which rest in a guiding slot 122 and can be operated by separate drives.

In the presented exemplary embodiment, the bottles 12 are supplied in two rows. According to the sort and arrangement of requested packages, it is also possible to supply, for example, the bodies 10, 12, 14, 16 in one, three, etc. rows.

Figure 12:
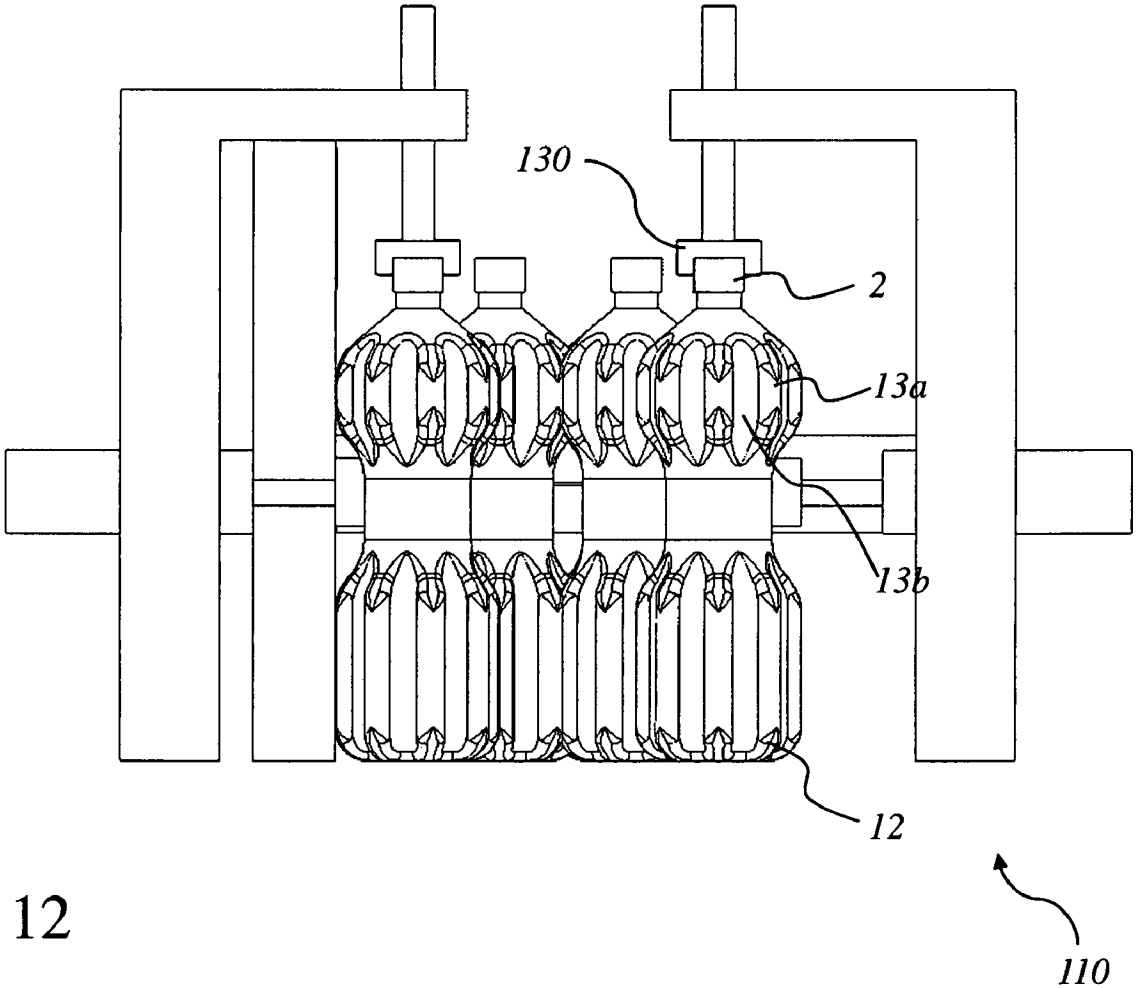
FIG. 12 shows a detail of the device for assembling bodies according to the invention as packages.

FIG. 12 illustrates an alignment unit 110 in the form of an alignment head of device 100 for assembling and connecting bodies according to the invention in packages 92*a*. A gripper 130 of the alignment head 110 grips the bodies 12 in an upper area, preferably at the closure 2, and rotates them to the correct position, so that they can be arranged and clipped together with the ribs 13*a* and corresponding notches 13*b* in the next step.

The alignment of the bottles 12 in the alignment head 110 is controlled, for example, by means of a detection device. In particular, it is possible to employ image recognition systems for the task of recording the shape of the bottles 12, especially of the arrangement of the ribs 13*a* and the notches 13*b*. The image recognition systems process the information and transfer it to the grippers 130, which rotate the bodies 12 until the ribs 13*a* and the notches 13*b* are positioned as requested.

Figure 13:
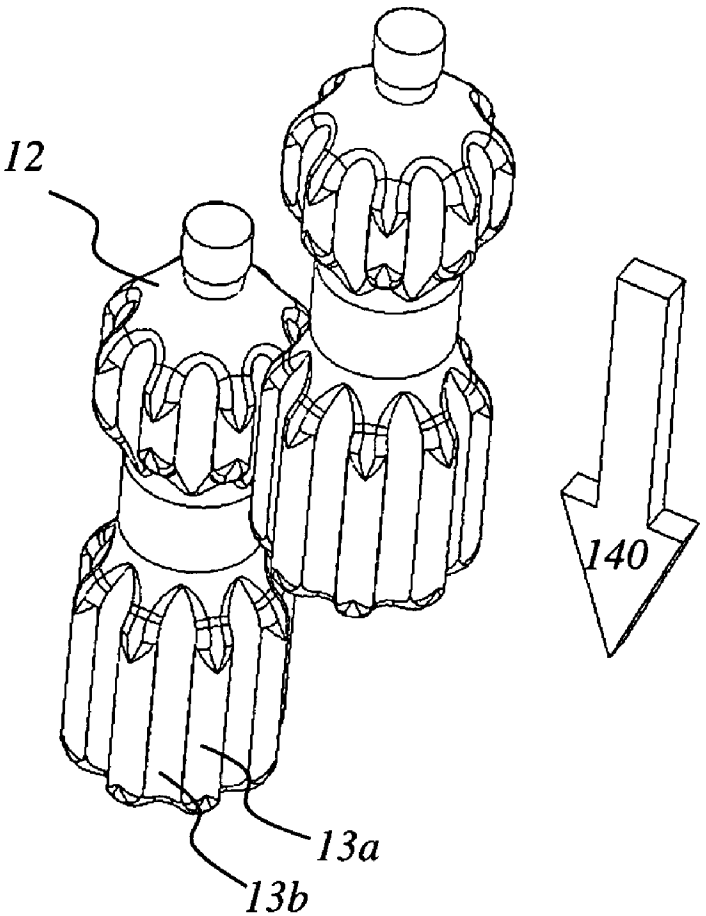
FIG. 13 shows the axial connecting of two bottles according to the second embodiment illustrated in FIG. 2.

FIG. 13 illustrates a further method for connecting bodies according to the invention. In this instance, it involves the axial connection of two bottles according to the embodiment 12, as shown in FIG. 2.

In particular, the bottles 12 are connected in an axial direction 140 synchronized by a robot. It is not necessary to clip the bodies 12 together in this instance; instead, the corresponding ribs 13*a* and notches 13*b* are fitted into each other. The said procedure is especially advantageous for bottles with a pronounced undercut, as they require no effort for being connected.

The invention has been described with reference to preferred embodiments. To the expert it is also conceivable, however, to make changes and modifications to the invention without leaving the scope of protection of the appended claims.

LIST OF REFERENCE CHARACTERS

2 Closure
10 Bottle according to a first embodiment
11*a* Connecting element: Rib
11*b* Connecting element: Notch
12 Bottle according to a second embodiment
12' Bottle pair comprising bottles according to a second embodiment
14 Bottle according to a third embodiment
15*a* Connecting element: Rib
15*b* Connecting element: Notch

16 Bottle according to a fourth embodiment
17*a* Connecting element: Rib
17*b* Connecting element: Notch
22 Undercut
32 Lower area
34 Upper area
42 Unstructured area/grip area/grip recess
44 Unstructured area/grip area/grip recess
46 Unstructured area/grip area/grip recess
50 Base
51 Top side
54*a* Securing element: Elevation
54*b* Securing element: Indentation
55 Shoulder/stop
60 Hot glue
80 Handle
90 Banderole
92*a/b* Package
96*a/b* Package
100 Device for producing packages
102 Transportation direction
110 Alignment unit/alignment head
112 First sliding device/slide
113 Cavity plate
114 Second sliding device/separating and arranging unit/article divider
120 Divider bar
122 Guiding slot
130 Gripper

What is claimed is:

1. Bodies with an essentially circular base shape and comprising:

a base;

a top side; and a lateral surface having a structuring arranged essentially parallel to a longitudinal axis of the body, the longitudinal axis being perpendicular to the base of the body, the structuring having connecting elements formed around an entire girth of the body, extending along more than four sides of the lateral surface; the connecting elements having additional securing elements and the additional securing elements being formed as elevations and indentations for additionally securing the bodies and preventing axial shifting.

2. The bodies as recited in claim 1 wherein the connecting elements form ribs with or without undercut, and/or the connecting elements extending along at least one axial section of the lateral surface.

3. The bodies as recited in claim 1 wherein the base and/or the top side comprises a shoulder.

4. A package comprising:

an assembly of at least two bodies of an essentially circular base shape, each body of the at least two bodies including a base, a top side and a lateral surface, the lateral surface of each body being formed with a structuring arranged essentially parallel to a longitudinal axis of the body, the longitudinal axis arranged perpendicular to a base of the body, the structuring being formed with connecting elements around an entire girth of the body, extending along more than four sides of the lateral surface, the structuring of a first body of the at least two bodies form-lockingly cooperating with corresponding structuring of a second body of the at least two bodies; the connecting elements having additional securing elements and the additional securing elements being formed as elevations and indentations for additionally securing the bodies and preventing axial shifting.

5. The package as recited in claim 4 wherein the connecting elements form ribs with or without undercut, and/or with the connecting elements extending along at least one axial section of the lateral surface.

6. The package as recited in claim 4 wherein the base of the body comprises a shoulder.

7. The package as recited in claim 4 further comprising adhesion points applied between the bodies and/or a banderole surrounding the bodies.

8. The package as recited in claim 4 further comprising a handle, the handle including two fastening areas and one holding area.

9. The package as recited in claim 8 wherein the fastening areas are fastenable between two connecting elements of one of the bodies and/or a connection between the handle and the body is detachable.

10. A method for producing packages from bodies of an essentially circular shape, each body having a structuring and connecting elements, the method comprising at least the following steps:

aligning at least two bodies, the bodies being rotated about their respective longitudinal axes so that corresponding connecting elements of the bodies, which are arranged essentially parallel to longitudinal axes of the bodies, are arranged opposite cooperating connecting elements; and assembling the at least two bodies into a first package so that the oppositely arranged connecting elements interlock in a form-locking manner and/or at least two first packages each having one of the bodies are arranged and connected to form a second package, the assembling further including having elevations interlock with indentations to prevent axial shifting.

* * * * *